US008564587B2

(12) United States Patent
Lee et al.

(10) Patent No.: US 8,564,587 B2
(45) Date of Patent: Oct. 22, 2013

(54) ORGANIC LIGHT EMITTING DIODE DISPLAY

(75) Inventors: Hyunjae Lee, Gyeonggi-do (KR); Dohyung Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 24 days.

(21) Appl. No.: 13/309,776

(22) Filed: Dec. 2, 2011

(65) Prior Publication Data

US 2012/0161637 A1 Jun. 28, 2012

(30) Foreign Application Priority Data

Dec. 22, 2010 (KR) ..... 10-2010-0132535

(51) Int. Cl.
*G09G 3/32* (2006.01)

(52) U.S. Cl.
USPC ..... 345/212; 345/76; 345/92; 345/204

(58) Field of Classification Search
USPC ..... 315/169.1–169.3, 122, 240; 345/76–83, 345/90–92, 204–205, 122, 107, 212, 690
See application file for complete search history.

(56) References Cited

U.S. PATENT DOCUMENTS

| | | | | |
|---|---|---|---|---|
| 7,164,401 | B2 * | 1/2007 | Kwon | 345/82 |
| 7,656,369 | B2 * | 2/2010 | Chung et al. | 345/80 |
| 7,724,218 | B2 * | 5/2010 | Kim et al. | 345/76 |
| 7,750,875 | B2 * | 7/2010 | Kim et al. | 345/82 |
| 8,242,983 | B2 * | 8/2012 | Yoo et al. | 345/76 |
| 8,253,664 | B2 * | 8/2012 | Shih et al. | 345/82 |
| 8,289,240 | B2 * | 10/2012 | Kwon | 345/76 |
| 8,325,113 | B2 * | 12/2012 | Kim et al. | 345/76 |
| 2007/0126690 | A1 | 6/2007 | Chae | |
| 2007/0279337 | A1 * | 12/2007 | Kim et al. | 345/76 |
| 2008/0238891 | A1 * | 10/2008 | Chiou | 345/204 |
| 2009/0051628 | A1 * | 2/2009 | Kwon | 345/77 |
| 2011/0069059 | A1 * | 3/2011 | Lee et al. | 345/212 |
| 2012/0069059 | A1 * | 3/2012 | Lee | 345/690 |

FOREIGN PATENT DOCUMENTS

| | | | |
|---|---|---|---|
| KR | 10-2007-0059251 | A | 6/2007 |
| KR | 10-2008-0113528 | A | 12/2008 |

OTHER PUBLICATIONS

Korean Office Action dated May 20, 2013 for corresponding application No. KR 10-2010-0132535.

* cited by examiner

*Primary Examiner* — Vibol Tan
(74) *Attorney, Agent, or Firm* — Morgan, Lewis & Bockius LLP

(57) ABSTRACT

An organic light emitting diode (OLED) display includes a display panel including data lines, scan lines crossing the data lines, and light emitting cells, which are arranged in a matrix form and each include an OLED, and a panel driving circuit, which reduces a reference voltage applied to an anode of the OLED to a ground level voltage in a sleep-out mode and adjusts the reference voltage at a voltage level greater than the ground level voltage. The reference voltage is held at a voltage level greater than the ground level voltage in a normal driving mode.

6 Claims, 6 Drawing Sheets

ORGANIC LIGHT EMITTING DIODE DISPLAY

This application claims the benefit of Korea Patent Application No. 10-2010-0132535 filed on Dec. 22, 2010, the entire contents of which is incorporated herein by reference for all purposes as if fully set forth herein.

BACKGROUND OF THE INVENTION

1. Field of the Invention

Embodiments of the invention relate to an organic light emitting diode (OLED) display.

2. Discussion of the Related Art

Various flat panel displays (FPDs), that may replace cathode ray tubes (CRTs) displays disadvantageous in light of the weight and the size, have been developed. Examples of the FPDs include liquid crystal display (LCDs), field emission displays (FEDs), plasma display panel (PDP) displays, and electroluminescence device (EL) displays.

The EL display is classified into an inorganic EL display and an organic light emitting diode (OLED) display depending on a material of a light emitting layer. The OLED display is a self-emitting display and has a number of advantages, such as a fast response time, a high emitting efficiency, a high luminance, and a wide viewing angle.

The OLED display may be driven by various methods including voltage driving, voltage compensating, current driving, digital driving, external compensating methods, etc.

An existing low-speed parallel connection method between devices is disadvantageous in price, power consumption, electromagnetic interference (EMI), size, etc. An existing serial interface suffers from an increase in complexity and a reduction in efficiency in an environment where a number of devices are connected to one another by a point-to-point connection method. To solve the problems of the existing interface circuit technologies, the interface circuit technology has been advancing toward a low voltage and high-speed serial transfer technology. The MIPI (Mobile Industry Processor Interface) Alliance, which defines standards for the serial interface between modules of a mobile device, implements the low voltage and high data transfer and thus has been considered as an optimum interface technology in mobile environments. Mobile information appliances using the MIPI may convert their operation mode into a sleep-in mode, a sleep-out mode, a normal driving mode (or display-on mode), or a dimmed low power (DLP) mode in response to standard commands of the MIPI Alliance. In the sleep-in mode and the DLP mode, driving voltages of a display panel are held at a ground level voltage, and driving circuits of the display panel do not operate. Therefore, power consumption of the mobile information appliances may be reduced. In the sleep-out mode, the driving voltages of the display panel increase to a driving voltage level, and the driving circuits of the display panel start to operate. In the normal driving mode, the driving circuits of the display panel normally operate and thus display an image input from a phone main chip.

A range of application for the OLED displays has been recently extended to display elements of the mobile information appliances. In the mobile information appliances using the OLED displays, when their operation mode is converted from the sleep-in mode to the sleep-out mode, each of pixels is overly charged to an anode voltage of an OLED formed on each pixel and may emit light. Hence, a user may see a phenomenon, in which the screen of the OLED display abnormally flickers, when the operation mode of the mobile information appliances is converted from the sleep-in mode to the sleep-out mode.

SUMMARY OF THE INVENTION

Embodiments of the invention provide an organic light emitting diode (OLED) display capable of preventing a display of an abnormal screen when the OLED display operates in a sleep-out mode.

In one aspect, there is an OLED display comprising a display panel including data lines, scan lines crossing the data lines, and light emitting cells arranged in a matrix form, each of the light emitting cells including an OLED, and a panel driving circuit configured to reduce a reference voltage applied to an anode of the OLED to a ground level voltage in a sleep-out mode and adjust the reference voltage at a voltage level greater than the ground level voltage, wherein the reference voltage is held at a voltage level greater than the ground level voltage in a normal driving mode.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the specific embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the invention.

Figure 1:
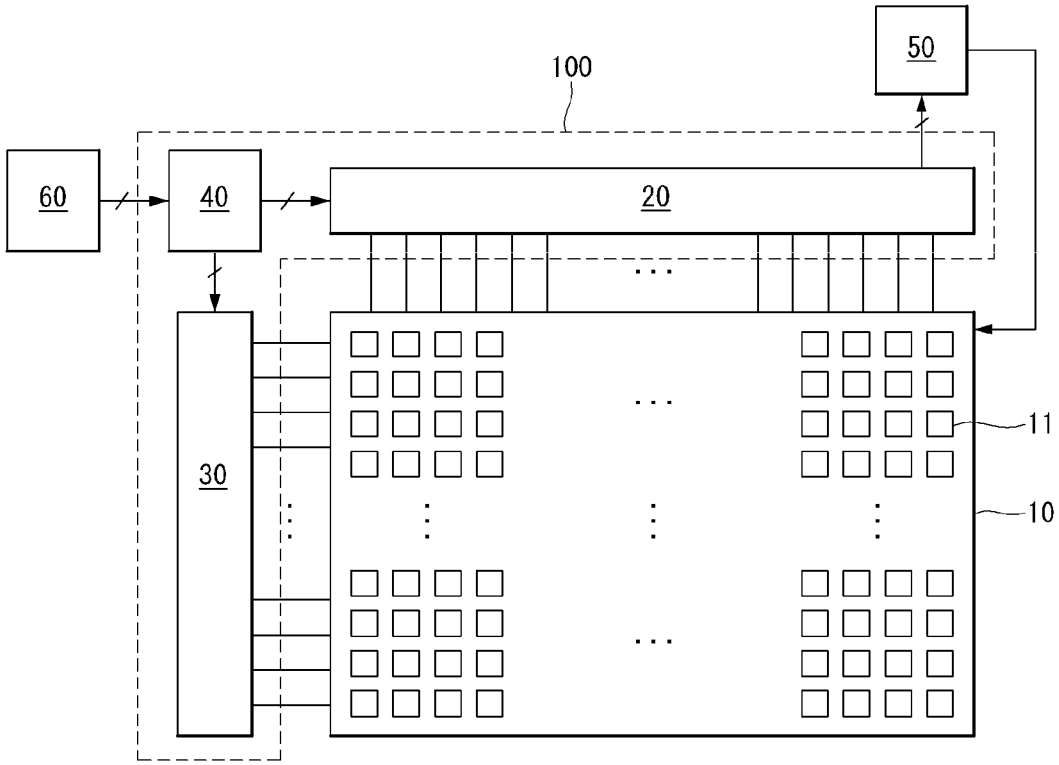
FIG. 1 is a block diagram of an organic light emitting diode (OLED) display according to an embodiment of the invention.
Figure 2:
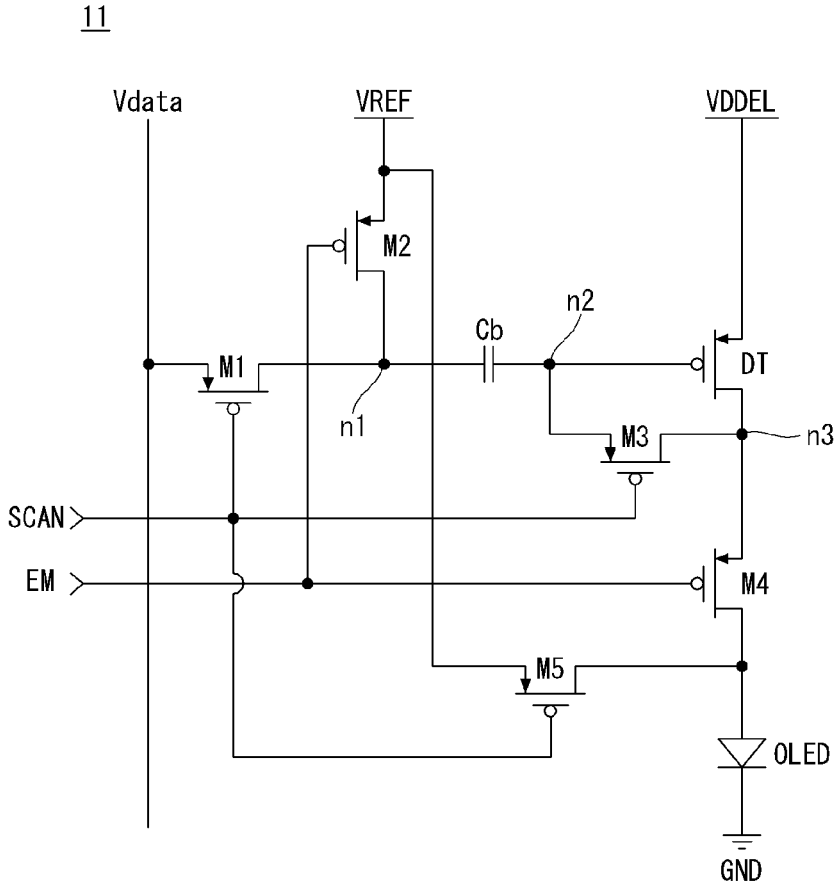
FIG. 2 is a circuit diagram illustrating a light emitting cell of FIG. 1.
Figure 3:
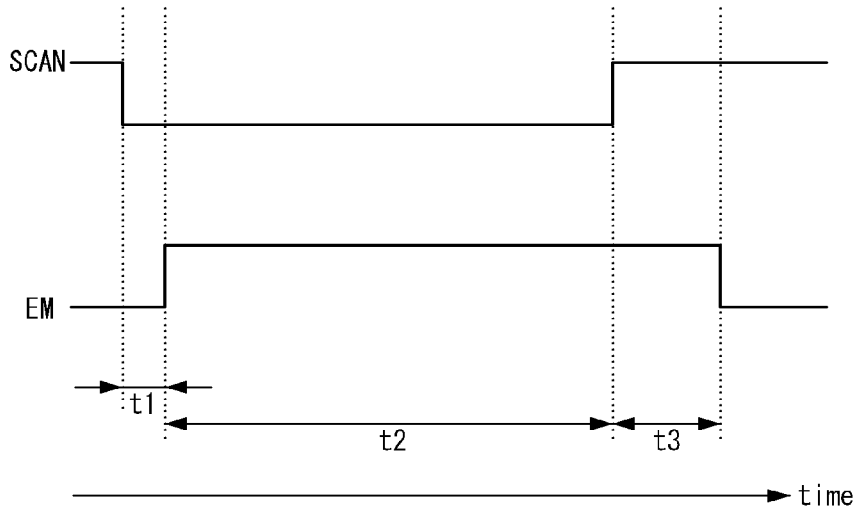
FIG. 3 illustrates waveforms of driving signals of the light emitting cell of FIG. 2.

As shown in FIGS. 1 to 3, an organic light emitting diode (OLED) display according to an embodiment of the invention includes a display panel 10, a data driver 20, a scan driver 30, a power generator 50, and a timing controller 40.

The display panel 10 includes data lines receiving a data voltage, scan lines, which cross the data lines and sequentially receive a scan pulse SCAN and a light emitting control pulse EM, and light emitting cells 11 arranged in a matrix form. The light emitting cells 11 receive a high potential power voltage VDDEL. As shown in FIG. 2, each of the light emitting cells 11 includes a plurality of thin film transistors (TFTs), a capacitor Cb, and an OLED. The light emitting cell 11 is initialized in response to the scan pulse SCAN and samples a threshold voltage of a driving TFT DT. The OLED of the light emitting cell 11 emits light by a current flowing through the driving TFT DT that is driven by the compensated data voltage obtained by compensating the threshold voltage of the driving TFT DT during a low logic period (or a light emitting period) of the light emitting control pulse EM.

The data driver 20 converts digital video data RGB into a gamma compensation voltage under the control of the timing controller 40 and generates the data voltage using the gamma compensation voltage. The data driver 20 supplies the data voltage to the data lines. The scan driver 30 supplies the scan pulse SCAN and the light emitting control pulse EM to the scan lines under the control of the timing controller 40.

In a sleep-out mode and a normal driving mode, in which the digital video data RGB is normally displayed, the power generator 50 is enabled to generate the high potential power voltage VDDEL for driving the light emitting cells 11. In a sleep-in mode and a dimmed low power (DLP) mode, the power generator 50 is disabled and generates no output. The power generator 50 may include a DC-DC converter and/or a low-dropout (LDO) regulator having a soft start function.

Figure 7:
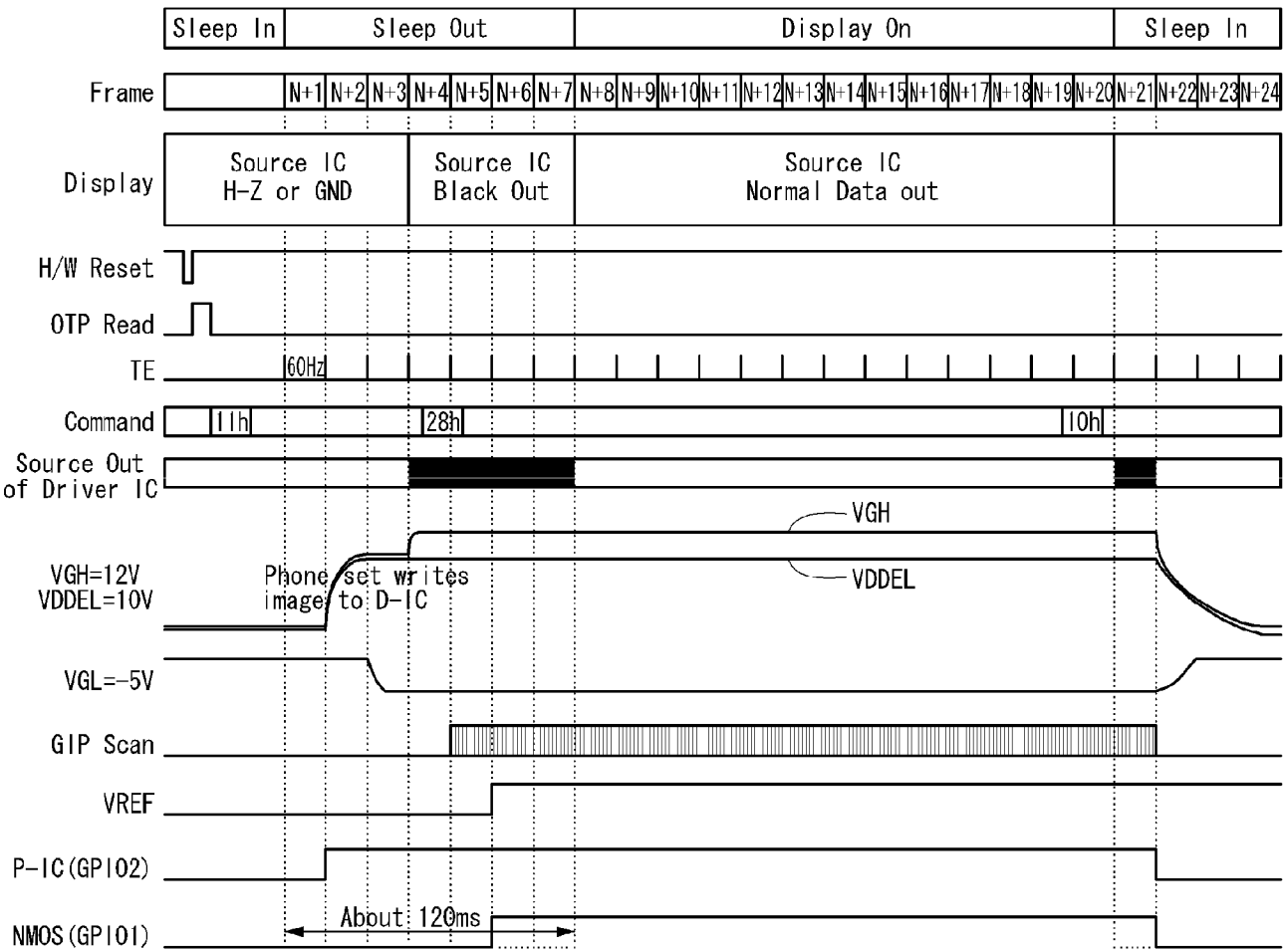
FIG. 7 is a waveform diagram illustrating operations of a sleep-in mode, a sleep-out mode, and a normal driving mode in an OLED display according to an embodiment of the invention.

The timing controller 40 receives external timing signals such as a vertical sync signal, a horizontal sync signal, and clocks from a host system 60 and generates timing control signals for controlling operation timings of the data driver 20 and the scan driver 30 based on the external timing signals. The vertical sync signal is generated once at a start timing of one frame period as shown in FIG. 7 and may function as a tearing effect (TE) signal for distinguishing a frame period from another frame period. The timing controller 40 supplies image data received from the host system 60 to the data driver 20 in the normal driving mode.

The host system 60 may be a phone system in mobile information appliances. The host system 60 is connected to a communication module (not shown), a camera module (not shown), an audio processing module (not shown), an interface module (not shown), a battery (not shown), a user input device (not shown), and the timing controller 40. The host system 60 generates a mode conversion command for converting the driving mode and supplies the mode conversion command to the timing controller 40. The host system 60 supplies the input image data and the external timing signals to the timing controller 40 in the normal driving mode.

The data driver 20, the scan driver 30, and the timing controller 40 may be integrated into a panel driver chip 100 that is a single chip. As sown in FIGS. 6 and 7, the panel driver chip 100 controls electric power under the control of the host system 60.

In a low voltage mode such as the sleep-in mode and the DLP mode, the panel driver chip 100 supplies the driving voltage to the light emitting cells 11 of the display panel 10 through an internal power source, and at the same time disables the power generator 50. In the sleep-out node and the normal driving mode, the panel driver chip 100 enables the power generator 50 to supply the driving voltage output from the power generator 50 to the light emitting cells 11 of the display panel 10. In the sleep-out mode, the panel driver chip 100 connects a reference voltage VREF to a ground level voltage source GND for a predetermined time and discharges an anode of the OLED formed on each pixel of the display panel 10. The panel driver chip 100 generates the reference voltage VREF at a voltage of about 2V in the normal driving mode.

As shown in FIG. 2, each of the light emitting cells 11 includes the OLED, six TFTs M1 to M5 and DT, and the capacitor Cb. The driving voltages, such as the high potential power voltage VDDEL, the ground level voltage VSS (or GND), or the reference voltage VREF, are supplied to each of the light emitting cells 11. The TFTs M1 to M5 and DT may be implemented as p-type metal oxide semiconductor field effect transistors (MOSFETs).

The high potential power voltage VDDEL is a direct current (DC) voltage of about 10V. The reference voltage VREF is set so that a difference between the reference voltage VREF and the ground level voltage GND is less than a threshold voltage of the OLED. For example, the reference voltage VREF may be set to about 2V. The reference voltage VREF may be set to a negative voltage so that a reverse bias may be applied to the OLED when the driving TFT DT connected to the OLED is initialized. In this instance, because the reverse bias is periodically applied to the OLED, the degradation of the OLED may be reduced. As a result, the life span of the OLED may increase.

The first switch TFT M1 forms a current path between a first node n1 and the data line in response to the scan pulse SCAN of a low logic level, which is generated during first and second time periods t1 and t2 shown in FIG. 3, thereby supplying a data voltage Vdata to the first node n1. The third switch TFT M3 forms a current path between a second node n2 and a third node n3 in response to the scan pulse SCAN of the low logic level generated during the first and second time periods t1 and t2 shown in FIG. 3, thereby operating the driving TFT DT as a diode. The fifth switch TFT M5 supplies the reference voltage VREF to the anode of the OLED in response to the scan pulse SCAN of the low logic level generated during the first and second time periods t1 and t2, thereby initializing the anode voltage of the OLED to the reference voltage VREF. In the first switch TFT M1, a source electrode is connected to the data line, a drain electrode is connected to the first node n1, and a gate electrode is connected to the scan line to which the scan pulse SCAN is supplied. In the third switch TFT M3, a source electrode is connected to the second node n2, a drain electrode is connected to the third node n3, and a gate electrode is connected to the scan line to which the scan pulse SCAN is supplied. The reference voltage VREF is supplied to a source electrode of the fifth switch TFT M5. A drain electrode of the fifth switch TFT M5 is connected to the anode of the OLED. A gate electrode of the fifth switch TFT M5 is connected to the scan line to which the scan pulse SCAN is supplied. The first node n1 is connected to the drain electrode of the first switch TFT M1, a drain electrode of the second switch TFT M2, and one terminal of the capacitor Cb. The second node n2 is connected to the other terminal of the capacitor Cb, a gate electrode of the driving TFT DT, and the source electrode of the third switch TFT M3. The third node n3 is connected to the drain electrode of the third switch TFT M3, a drain electrode of the driving TFT DT, and a source electrode of the fourth switch TFT M4.

The second and fourth switch TFTs M2 and M4 are turned off in response to the light emitting control pulse EM of a high logic level generated during second and third time periods t2 and t3 shown in FIG. 3, and maintain an ON-state during the remaining time. The reference voltage VREF is supplied to a source electrode of the second switch TFT M2, and a drain electrode of the second switch TFT M2 is connected to the first node n1. A gate electrode of the second switch TFT M2 is connected to the scan line to which the light emitting control pulse EM is supplied. A source electrode of the fourth switch TFT M4 is connected to the third node n3, and a drain electrode of the fourth switch TFT M4 is connected to the anode of the OLED and the drain electrode of the fifth switch TFT M5. A gate electrode of the fourth switch TFT M4 is connected to the scan line to which the light emitting control pulse EM is supplied.

The capacitor Cb is connected in series between the first node n1 and the second node n2. The capacitor Cb is charged to a difference voltage between the voltage of the first node n1 and the voltage of the second node n2 during the second time period t2 of FIG. 3, thereby sampling the threshold voltage of the driving TFT DT. The driving TFT DT receives the voltage of the capacitor Cb, which stores the threshold voltage-compensated data voltage Vdata, as a gate voltage and adjusts an amount of current flowing in the OLED depending on the threshold voltage-compensated data voltage Vdata. The high potential power voltage VDDEL is supplied to a source electrode of the driving TFT DT, and a drain electrode of the driving TFT DT is connected to the third node n3. A gate electrode of the driving TFT DT is connected to the second node n2.

The anode of the OLED is connected to the drain electrodes of the fourth and fifth switch TFTs M4 and M5, and the cathode of the OLED is connected to the ground level voltage source GND. The current flowing in the OLED, referred to as $I_{OLED}$ in Equation 1, is not affected by a deviation of the threshold voltage of the driving TFT DT or the high potential power voltage VDDEL in the normal driving mode as indicated by the following Equation 1:

$$I_{OLED} = k(Vdata - VREF)^2,\ k = \frac{1}{2}(\mu CoxW/L) \quad (1)$$

where 'k' is a constant using a mobility μ, a parasitic capacitance Cox, and a channel ratio W/L of the driving TFT DT as a function.

Figure 4:
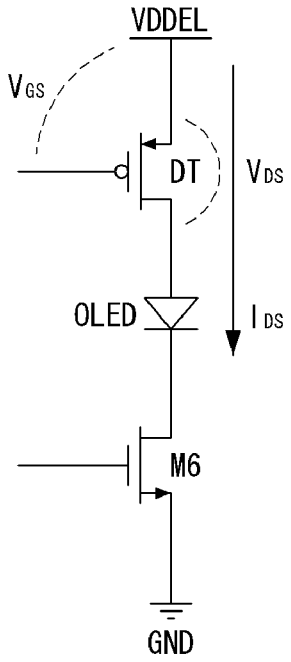
FIGS. 4 and 5 illustrate voltage-current characteristics of a driving thin film transistor (TFT)

As shown in FIG. 4, the cathode of the OLED may be connected to the ground level voltage source GND through a sixth switch TFT M6. The sixth switch TFT M6 may be an N-type MOSFET (NMOS). The sixth switch TFT M6 may be mounted on a printed circuit board (PCB) on which the panel driver chip 100 is mounted.

In the embodiment of the invention, the plurality of sixth switch TFTs M6 may be not connected to the pixels, respectively. Namely, one sixth switch TFT M6 may be commonly connected to all of the pixels. Thus, one sixth switch TFT M6 may be mounted on the PCB. A source electrode of the sixth switch TFT M6 is connected to the cathodes of the OLEDs formed on the respective pixels of the display panel 10, and a drain electrode of the sixth switch TFT M6 is connected to the ground level voltage source GND. A gate electrode of the sixth switch TFT M6 is connected to a first low power mode control terminal GPIO1 of the panel driver chip 100.

When an output voltage from the first low power mode control terminal GPIO1 is at a high logic level, the sixth switch TFT M6 maintains an ON state. Hence, the cathodes of the OLEDs of the light emitting cells 11 are connected to the ground level voltage source GND. When the output voltage from the first low power mode control terminal GPIO1 turns to a low logic level, the sixth switch TFT M6 is turned off, thereby cutting off the current path between the OLEDs of the light emitting cells 11 and the ground level voltage source GND. When a previously determined image with a low luminance is displayed on the display panel 10 in the DLP mode, the sixth switch TFT M6 maintains the ON state in the DLP mode. Because no data is displayed on the display panel 10 in the sleep-in mode, the sixth switch TFT M6 maintains an OFF state in the sleep-in mode and is turned on in the sleep-out mode.

When the panel driver chip 100 operates in the sleep-out mode, all of the driving voltages of the display panel 10 increase to a normal level. The power generator 50 is enabled in the sleep-out mode, and thus the high potential power voltage VDDEL output from the power generator 50 increases from 0V to about 10V in the sleep-out mode.

Figure 5:
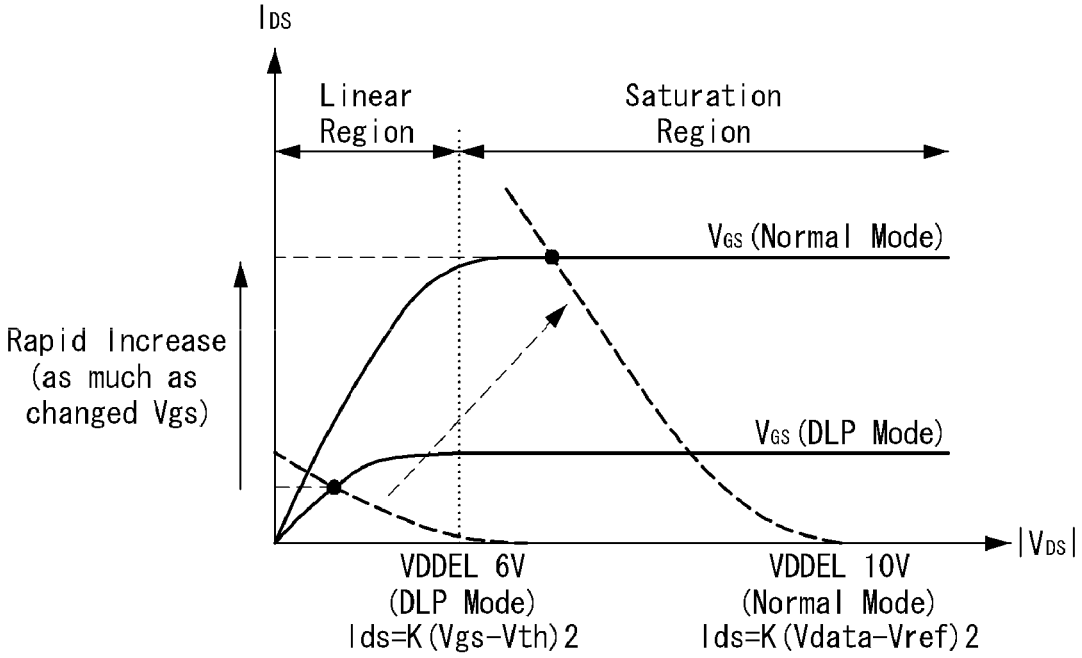

As shown in FIG. 5, when the high potential power voltage VDDEL increases as above, a gate-source voltage $V_{GS}$ in operation characteristics of the driving TFT DT operates in a linear region, in which the high potential power voltage VDDEL rapidly increases and a drain-source current $I_{DS}$ of the driving TFT DT rapidly increases. Further, when the high potential power voltage VDDEL is uniformly held, the gate-source voltage $V_{GS}$ in the operation characteristics of the driving TFT DT operates in a saturation region. Thus, when the driving TFT DT operates in the linear region in the sleep-out mode, charges are rapidly accumulated on the anode of the OLED, and the OLED emits light by a leakage current of the OLED. As a result, the user may perceive the screen flicker because of the abnormal light emission of the OLED in the sleep-out mode.

The OLED may be prevented from emitting light by turning off the sixth switch TFT M6 in the sleep-out mode. However, the sixth switch TFT M6 has to be turned on before the panel driver chip 100 performs the operation of the normal driving mode, and the OLED may abnormally emit light at a turn-on time point of the sixth switch TFT M6 because of charges excessively accumulated on the OLED. Thus, the OLED cannot be prevented from abnormally emitting light in the sleep-out mode through only the control of the sixth switch TFT M6. In FIG. 5, the dotted line crossing the $V_{GS}$ curve of the driving TFT DT is a current curve of the OLED formed on each pixel. The current curve of the OLED is shifted to the left as the voltage applied through the driving TFT DT decreases.

Figure 6:
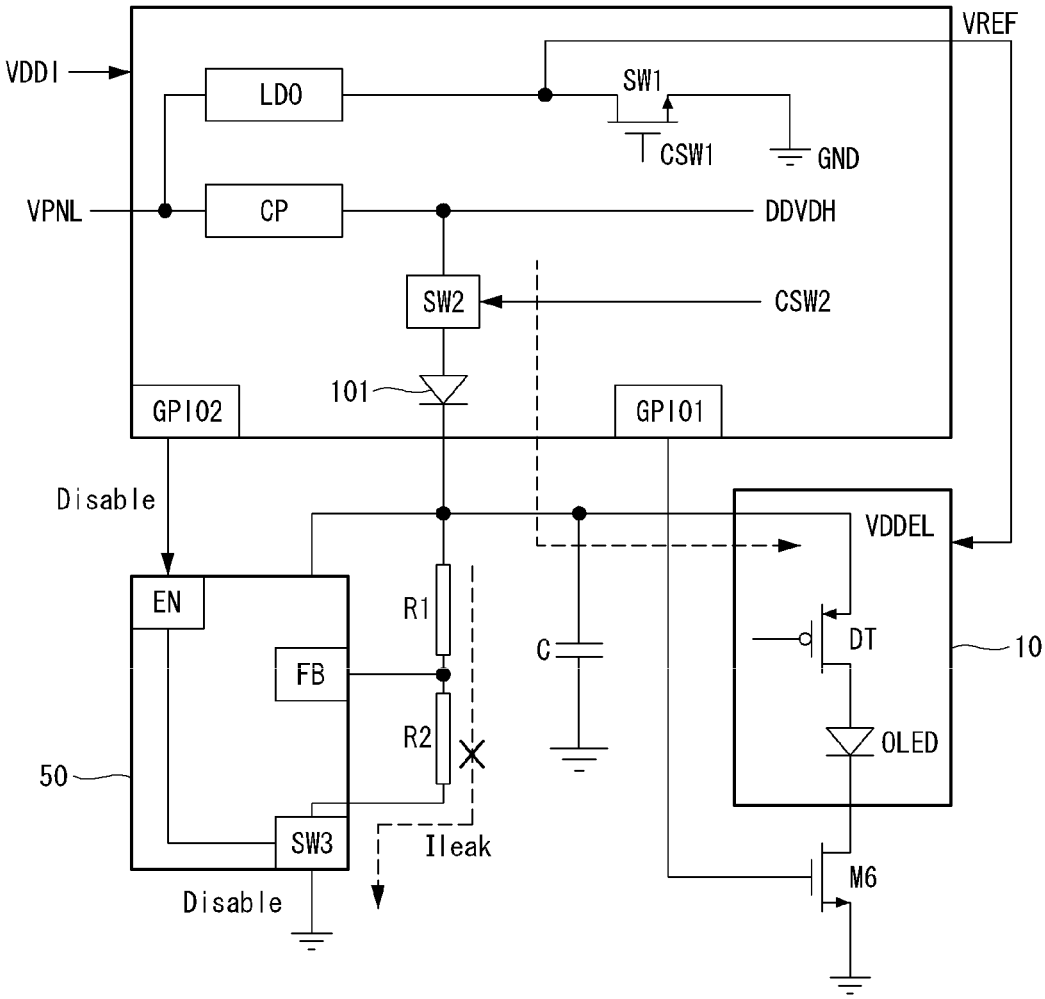
FIG. 6 is a circuit diagram illustrating a power control operation of a panel driver chip.

FIG. 6 is a circuit diagram illustrating a power control operation of the panel driver chip 100. FIG. 7 is a waveform diagram illustrating operations of the sleep-in mode, the sleep-out mode, and the normal driving mode in the OLED display according to the embodiment of the invention.

More specifically, FIG. 6 illustrates only a portion of the power control related circuit of each of the panel driver chip 100, the power generator 50, and the display panel 10. Circuits other than the power control related circuit were omitted in FIG. 6.

As shown in FIGS. 6 and 7, the panel driver chip 100 includes a regulator LDO and a first switch SW1.

The panel driver chip 100 receives a panel voltage VPNL and an input voltage VDDI. The input voltage VDDI is about 1.8V DC and is input to a power terminal of a frame memory of the panel driver chip 100 in an initial stage of the sleep-out mode so as to drive the frame memory of the panel driver chip 100. The panel voltage VPNL is about 2.3V DC to 4.8V DC and may be the DC voltage of battery power in mobile information appliances. The regulator LDO converts the panel voltage VPNL into the reference voltage VREF of about 2V DC.

The first switch SW1 includes a drain electrode connected to an input terminal of the regulator LDO, a source electrode connected to the ground level voltage source GND, and a gate electrode to which a first switch control signal CSW1 is applied. The first switch SW1 may be an N-type MOSFET (NMOS).

The first switch SW1 maintains an ON state under the control of the host system 60 during five frame periods (N+1) to (N+5) from a starting time point (i.e., N+1) of the sleep-out mode, thereby reducing the reference voltage VREF to the ground level voltage (i.e., 0V). The panel driver chip 100 normally applies the scan pulse and the light emitting control pulse (GIP Scan) to the scan lines from the fifth frame period (N+5) appearing after four frame periods passed from the starting time point (N+1) of the sleep-out mode. Further, the panel driver chip 100 starts to supply a black gray level voltage to the data lines from the fifth frame period (N+5).

The first switch SW1 is turned off under the control of the host system 60 from a sixth frame period (N+6) appearing after five frame periods passed from the starting time point (N+1) of the sleep-out mode, thereby cutting off a current path between an output terminal of the regulator LDO and the ground level voltage source GND. Hence, the reference voltage VREF increases to the normal driving voltage level. The host system 60 generates the first switch control signal CSW1 and controls the first switch SW1.

When the fifth switch TFT M5 shown in FIGS. 2 and 3 is turned on from the sixth frame period (N+6) of the sleep-out mode, the anode of the OLED is connected to the ground level voltage source GND through the first switch SW1. In this instance, charges accumulated on the anode of the OLED are discharged. As a result, the OLED may be prevented from abnormally emitting light in the sleep-out mode.

The panel driver chip 100 further includes a charge pump CP, a second switch SW2, and a diode 101.

The charge pump CP converts the panel voltage VPNL into a DDVDH voltage level of about 6V. The DDVDH voltage level is converted into a high potential voltage (or a gate high voltage referred to as VGH in FIG. 7) of the scan pulse and a low potential voltage (or a gate low voltage referred to as VGL in FIG. 7) of the scan pulse through a regulator (not shown).

The second switch SW2 includes a drain electrode connected to an output terminal of the charge pump CP, a source electrode connected to an anode of the diode 101, and a gate electrode to which a second switch control signal CSW2 is applied. The second switch SW2 may be an N-type MOSFET (NMOS). In the normal driving mode, the second switch SW2 maintains an OFF state, thereby cutting off a current path between the charge pump CP and the diode 101. In the sleep-in mode and the DLP mode, the second switch SW2 is turned on, thereby forming the current path between the charge pump CP and the diode 101. Hence, the DDVDH voltage level output from the charge pump CP is supplied to the diode 101. The host system 60 generates the second switch control signal CSW2 and controls the second switch SW2.

An anode electrode of the diode 101 is connected to the second switch SW2. A cathode electrode of the diode 101 is connected to a high potential power voltage output terminal of the power generator 50, a high potential power voltage supply terminal of the display panel 10, a capacitor C, and a first resistor R1, wherein a feedback voltage division resistor circuit includes the first resistor R1 and a second resistor R2.

The DDVDH voltage level is supplied to the light emitting cells 11 of the display panel 10 through the second switch SW2 and the diode 101 in the sleep-in mode and the DLP mode. Thus, the high potential power voltage VDDEL supplied to the light emitting cells 11 is generated as the voltage of about 10V supplied from the power generator 50 in the normal driving mode. Further, the high potential power voltage VDDEL supplied to the light emitting cells 11 is reduced to a threshold voltage of the diode 101 (for example, about 6V) generated inside the panel driver chip 100 in the sleep-in mode and the DLP mode.

The panel driver chip 100 reverses an enable/disable signal output through a second low power mode control terminal GPIO2 under the control of the host system 60. For example, the panel driver chip 100 outputs the enable/disable signal of a high logic level through the second low power mode control terminal GPIO2 in the normal driving mode to enable the power generator 50. On the other hand, the panel driver chip 100 outputs the enable/disable signal of a low logic level through the second low power mode control terminal GPIO2 in the low power mode to disable the power generator 50.

The power generator 50 includes an enable terminal EN connected to the second low power mode control terminal GPIO2 of the panel driver chip 100 and a third switch SW3. The power generator 50 is enabled in response to the high logic voltage of the second low power mode control terminal GPIO2 during a period ranging from the second frame period (N+2) of the sleep-out mode to a period of the normal driving mode. When the power generator 50 is enabled, the power generator 50 generates the high potential power voltage VDDEL of about 10V for driving the pixels of the display panel 10.

In the normal driving mode, the third switch SW3 connects the second resistor R2 of the feedback voltage division resistor circuit to the ground level voltage source GND in response to the high logic voltage of the second low power mode control terminal GPIO2. The first resistor R1 of the feedback voltage division resistor circuit is connected to the high potential power voltage supply terminal of the display panel 10 and the capacitor C. The third switch SW3 may be an N-type MOSFET (NMOS) including a source electrode connected to the second resistor R2, a drain electrode connected to the ground level voltage source GND, and a gate electrode to which the voltage of the second low power mode control terminal GPIO2 is applied through the enable terminal EN.

In the normal driving mode, the power generator 50 detects a variation of a feedback signal input to a feedback terminal FB through the feedback voltage division resistor circuit and adjusts the high potential power voltage VDDEL to be supplied to the display panel 10, thereby constantly maintaining the high potential power voltage VDDEL supplied to the pixels of the display panel 10 even when a load of the display panel 10 is changed.

In the DLP mode, the power generator 50 is disabled in response to a low logic voltage of the second low power mode control terminal GPIO2 and thus generates no output. In the DLP mode, the third switch SW3 is turned off in response to the low logic voltage of the second low power mode control terminal GPIO2, thereby cutting off a leak current Ileak flowing in the ground level voltage source GND through the feedback voltage division resistor circuit. Hence, the power consumption may be minimized.

In FIG. 7, 'H/W Reset' is a reset signal for reseting the panel driver chip 100. When the reset signal H/W Reset is applied to the panel driver chip 100, the panel driver chip 100 loads register values stored in its internal memory and initializes all of built-in register values. The register values may include white (W), red (R), green (G), and blue (B) coordinate values and a luminance value. The panel driver chip 100 writes R, G, and B values suitable for characteristics of the corresponding display panel to the internal memory in response to the reset signal H/W Reset, so as to compensate for the display panel 10 irrespective of a deviation of the display panel 10. The reset signal H/W Reset is generated by the host system 60.

In FIG. 7, '11h', '28h', and '10h' are mode conversion commands, which is generated by the host system 60 and is applied to the panel driver chip 100 in the mobile information appliances to which the MIPI Alliance is applied. More specifically, '11h' is the sleep-out mode command and converts the operation of the panel driver chip 100 of a standby state in the sleep-in mode into the operation of the sleep-out mode. '28h' is the display off command and cuts off the data output from the panel driver chip 100 or controls the data voltage output from the panel driver chip 100 at a black gray level, so that all the pixels of the display panel 10 display the black gray level. '10h' is the command for converting the operation of the panel driver chip 100 into the operation if the sleep-in mode of the standby state.

As described above, the OLED display according to the embodiment of the invention discharges the reference voltage applied to the anode of the OLED formed on each pixel to the ground level voltage in the sleep-out mode, thereby preventing the display of the abnormal screen when the OLED display operates in the sleep-out mode.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode (OLED) display comprising:

a display panel including data lines, scan lines crossing the data lines, and light emitting cells arranged in a matrix form, each of the light emitting cells including an OLED; and a panel driving circuit configured to reduce a reference voltage applied to an anode of the OLED to a ground level voltage in a sleep-out mode and adjust the reference voltage at a voltage level greater than the ground level voltage, wherein the reference voltage is held at a voltage level greater than the ground level voltage in a normal driving mode.

2. The OLED display of claim 1, wherein the panel driving circuit includes:

a regulator configured to convert a first DC input voltage into the reference voltage; and a first switch configured to connect an output of the regulator to a ground level voltage source under the control of an external host system and cut off a current path between the output of the regulator and the ground level voltage source.

3. The OLED display of claim 1, further comprising a DC-DC converter configured to be enabled in the normal driving mode to generate a high potential power voltage in the display panel and to be disabled in a sleep-in mode and a dimmed low power (DLP) mode, wherein the panel driving circuit disables the DC-DC converter in the sleep-in mode and the DLP mode and supplies the high potential power voltage generated inside the DC-DC converter to the display panel.

4. The OLED display of claim 3, wherein the panel driving circuit includes:

a charge pump configured to convert a DC input voltage into a first high potential power voltage;

a diode connected to a high potential power voltage supply terminal of the display panel; and a second switch configured to supply the first high potential power voltage output from the charge pump to a driving thin film transistor (TFT) of each of the light emitting cells of the display panel through the diode under the control of an external host system in the sleep-in mode and the DLP mode.

5. The OLED display of claim 4, wherein the DC-DC converter supplies a second high potential power voltage greater than the first high potential power voltage to the driving TFT of each of the light emitting cells through the diode in the normal driving mode.

6. The OLED display of claim 5, wherein the DC-DC converter includes:

a feedback resistor connected to the high potential power voltage supply terminal of the display panel; and a third switch configured to cut off a current path between one terminal of the feedback resistor and a ground level voltage source, wherein the third switch is turned off under the control of the panel driving circuit in the sleep-in mode and the DLP mode and cuts off a current path between the feedback resistor and the ground level voltage source.

* * * * *